US005426882A

United States Patent [19]

Dornaus

[11] Patent Number: 5,426,882

[45] Date of Patent: Jun. 27, 1995

[54] FIREARM HAVING IMPROVED SAFETY AND ACCURACY FEATURES

[75] Inventor: Thomas F. Dornaus, Norwalk, Calif.

[73] Assignee: Richard A. Voit, Ketchum, Ohio

[21] Appl. No.: 296,278

[22] Filed: Aug. 24, 1994

Related U.S. Application Data

[60] Continuation of Ser. No. 79,339, Jun. 16, 1993, abandoned, which is a division of Ser. No. 537,064, Jun. 12, 1990, Pat. No. 5,245,776.

[51] Int. Cl.[6] ..... F41G 1/01

[52] U.S. Cl. ..... 42/100; 33/243; 33/258; 33/260

[58] Field of Search ..... 42/100; 33/233, 241, 33/242, 243, 252, 253, 254, 255, 256, 257, 258, 259, 260

[56] References Cited

U.S. PATENT DOCUMENTS 2,494,163 1/1950 Davis ..... 33/257
3,641,676 2/1972 Knutsen et al. ..... 42/100

FOREIGN PATENT DOCUMENTS 16044 4/1904 Austria ..... 33/233

*Primary Examiner*—Stephen C. Bentley
*Attorney, Agent, or Firm*—Stetina Brunda & Buyan

[57] ABSTRACT

An improved firearm having a passive firing pin lock, a hammer drop mechanism, a V-block type barrel bushing, and square sight inlays is disclosed. The passive firing pin block prevents accidental discharge when the gun is dropped. The hammer drop mechanism permits the hammer to be safely lowered when a cartridge is present in the chamber without actuating the trigger. The V-block type barrel bushing accurately repositions the forward end of the barrel relative to the sights to provide maximum accuracy. The square sight inlays allow the user to quickly and precisely aim the firearm.

5 Claims, 9 Drawing Sheets

Fig. 7
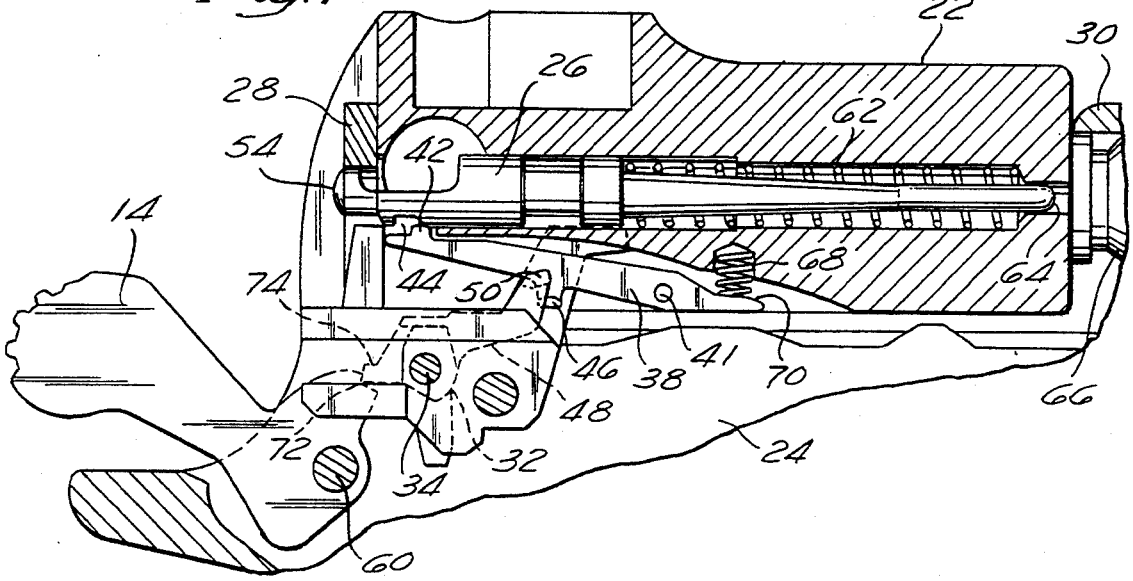
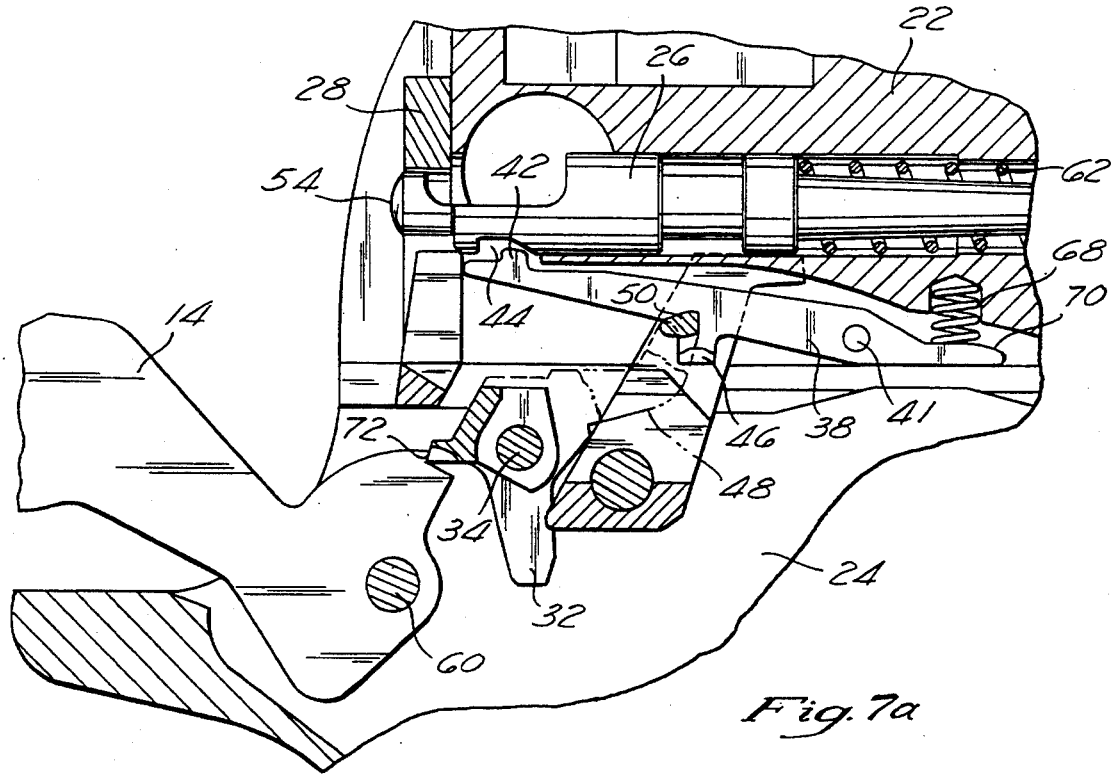
Fig. 7a

Fig. 8
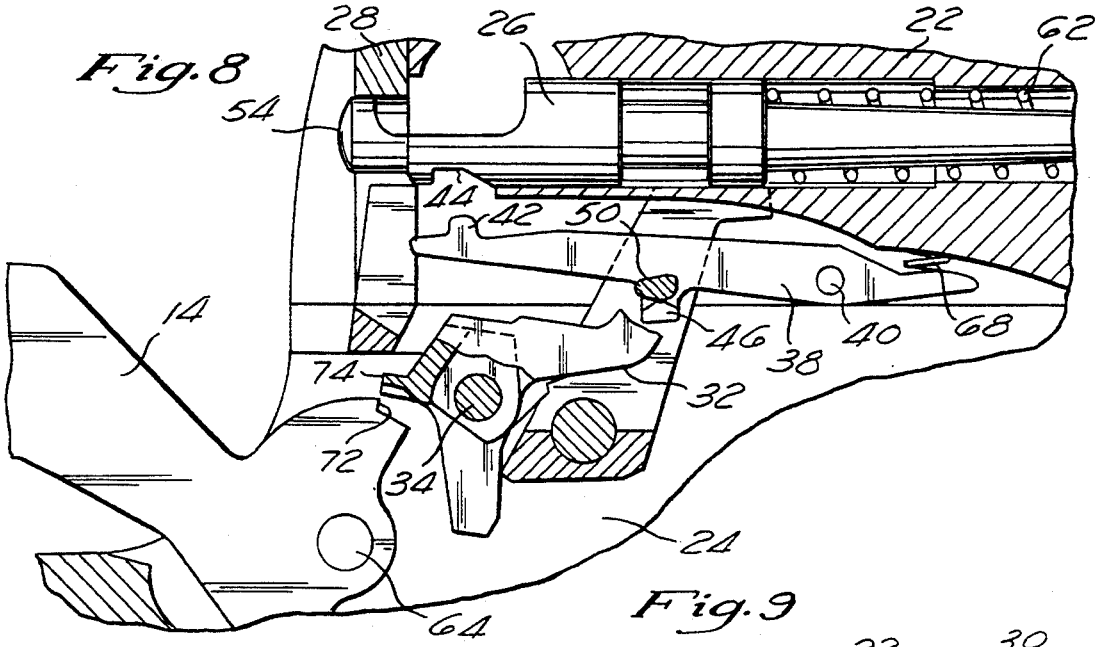
Fig. 9
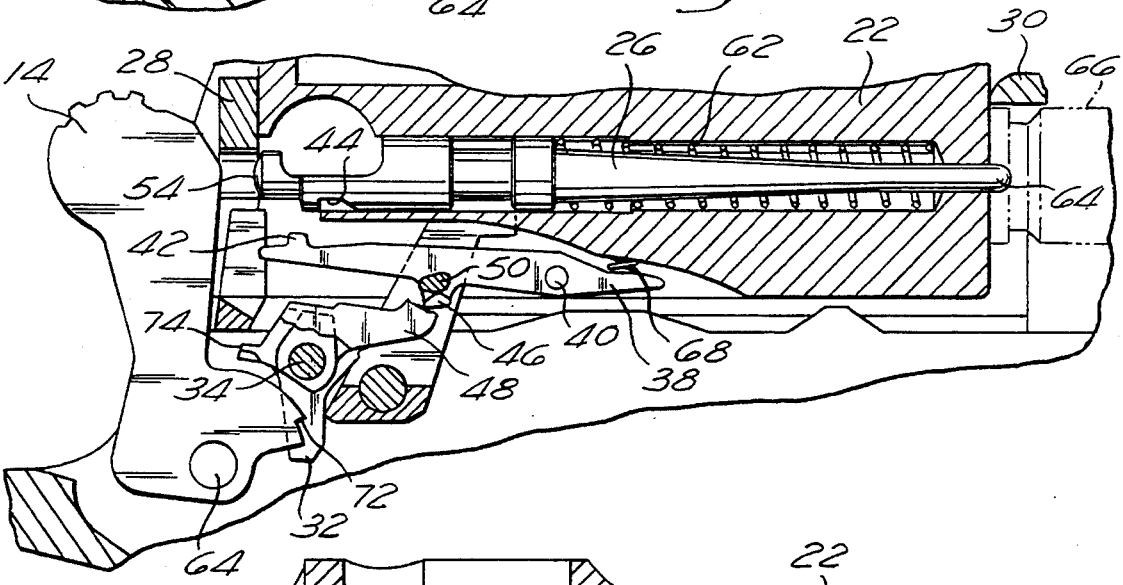
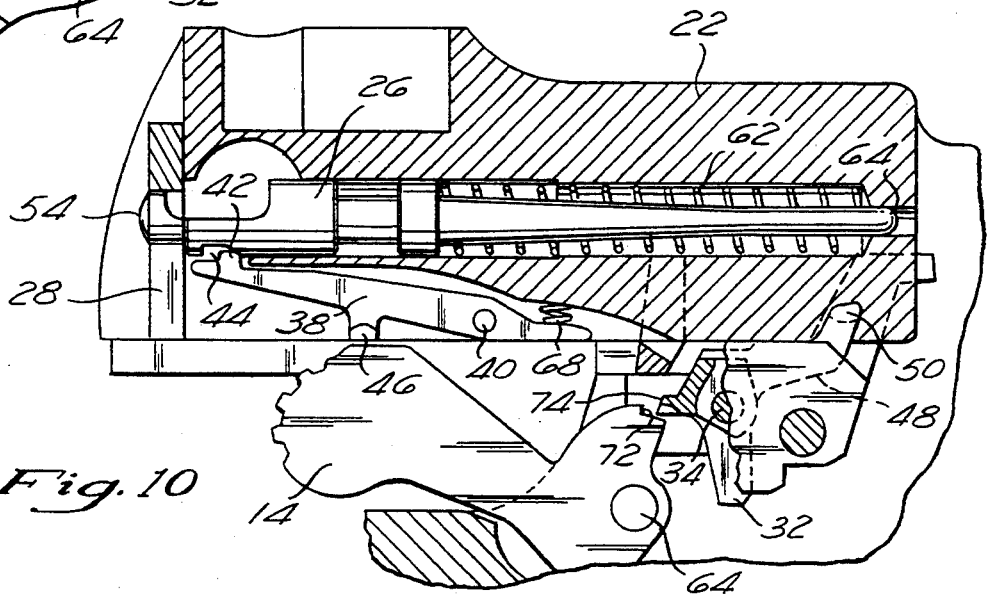
Fig. 10

Fig. 14
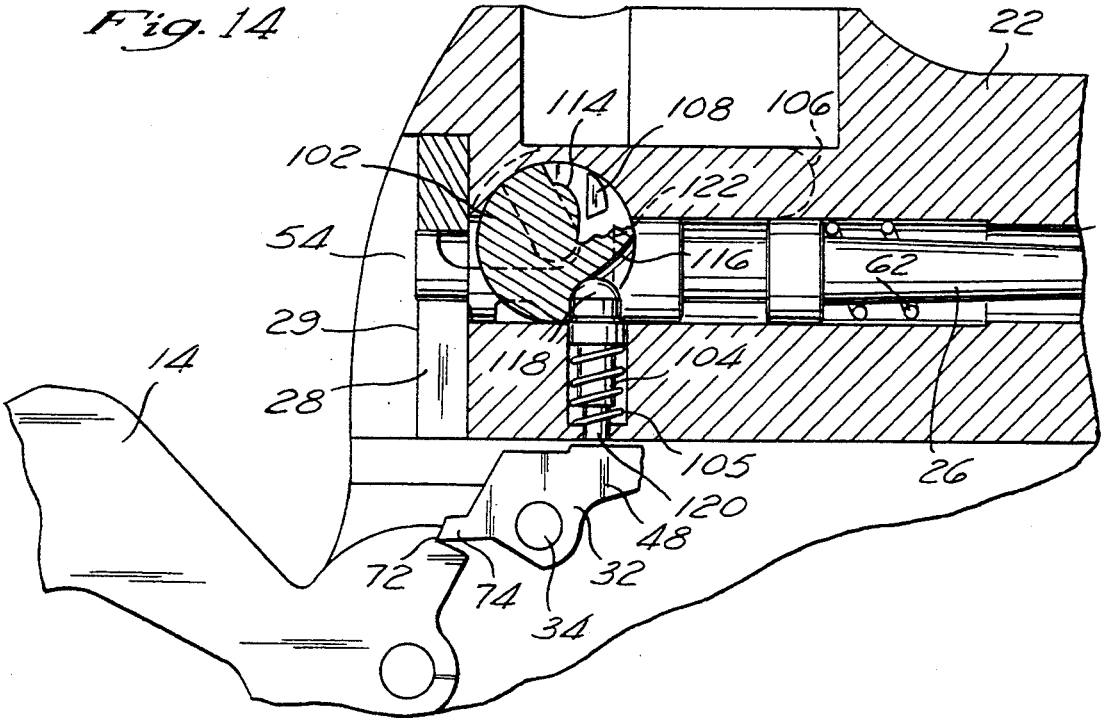
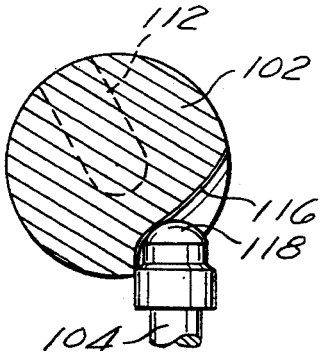
Fig. 14A
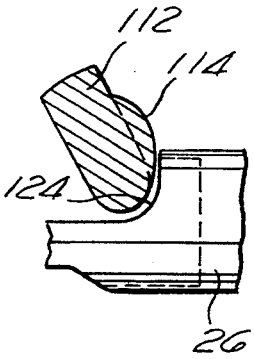
Fig. 14B
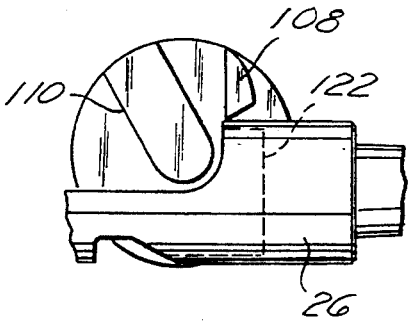
Fig. 14C

FIREARM HAVING IMPROVED SAFETY AND ACCURACY FEATURES

This application is a continuation of application Ser. No. 08/079,339, filed Jun. 16, 1993, now abandoned, which is a division of Ser. No. 07/537,064, filed Jun. 12, 1990 now U.S. Pat. No. 5,245,776.

FIELD OF THE INVENTION

The present invention relates generally to firearms and more particularly to an improved firearm having a passive firing pin lock, a hammer drop mechanism, a V-block type barrel bushing, and square sight inlays.

BACKGROUND OF THE INVENTION

Firearms having inertial firing pins which, when struck by the hammer of the firearm, are driven forward to strike and discharge a cartridge are well known. Several devices have been proposed to selectively lock the firing pin in order to prevent the firearm from being accidentally discharged. Such accidental discharge may occur in the event that the firearm is dropped from a distance of several feet and subsequently lands in such a manner that inertia carries the firing pin forward, thus causing it to strike the cartridge.

Manual firing pin locks are well known. They are typically located within the slide of an automatic or semiautomatic pistol and function to prevent the firing pin from contacting a chambered cartridge when activated. There is a tendency not to activate such manually operated firing pin lock mechanisms when it is anticipated that rapid and unexpected use of the gun may be required, e.g. during law enforcement or combat use. In such situations, the user does not want to be forced to remember to disengage the firing pin lock under stressful conditions, nor does he want to take the time to do so.

Passive firing pin locks such as that described in U.S. Pat. No. 4,555,861 issued to Khoury are known. Such devices have the advantage of not requiring the user to manually engage and disengage the lock. Rather, the lock is automatically engaged when the trigger is in the non-depressed or unactuated position and is automatically disengaged when the trigger is in the depressed or actuated position.

Prior art passive firing pin locks such as the Khoury device suffer, however, from the inherent deficiency that the firing pin is necessarily free to travel forward any time the trigger is depressed, including during the chambering of a cartridge. In such firearms, a malfunction of the disconnector or sear can cause a normally semiautomatic gun to function in a fully automatic mode. A semiautomatic firearm discharges one cartridge each time the trigger is pulled. A fully automatic firearm continues to fire as long as the trigger is depressed and cartridges remain to be fired. Unexpected fully automatic operation could result in the firearm being discharged in an inappropriate direction, possibly resulting in injury or death. Since fully automatic operation requires a stronger grip on the firearm and a firm stance to maintain control of the firearm.

Additionally, since in the Khoury device the firing pin lock does not re-engage the firing pin until the trigger is released, it is possible that an accidental discharge could occur prior to releasing the trigger. For example, in a combat environment the firearm could be struck by a bullet or shrapnel immediately after the firearm has been fired but prior to releasing the trigger. During this time the passive firing pin lock of the Khoury device would be inactive and therefore would not function to prevent the firing pin from being driven forward and discharging the weapon. Therefore, it is possible that an accidental discharge could occur. Also, it is conceivable that the user could fall and permit the firearm to strike a hard surface prior to releasing the trigger, thus driving the firing pin forward and accidentally discharging the firearm.

It would therefore be desireable to lock the firing pin in a retracted position at all times except when it is explicitly desired that the firearm be discharged. This would prevent both unexpected fully automatic operation and accidental discharge.

Also, such contemporary passive firing pin locks are comparatively complex in their structure. The Khoury device is typical in this regard and includes a double lever and pin arrangement which is comparatively prone to malfunction due to excessive wear, contamination, or breakage. It would therefore be desirable to provide a mechanically simpler mechanism for preventing undesired forward motion of the firing pin.

Double action semi-automatic pistols are also well known in the art. Pulling the trigger of a double action pistol both cocks the hammer and causes it to fall upon the firing pin. This eliminates the need to separately cook the hammer prior to pulling the trigger. Thus, double action pistols are more effective when quick and unexpected use may be required.

Since the hammer of a double action semi-automatic pistol does not have to be separately cocked and the pistol is therefore capable of being fired by merely pulling the trigger, it is often desireable to keep a cartridge in the chamber. This permits rapid use of the pistol by merely aiming and pulling the trigger. To chamber a cartridge, the slide is pulled back and released, thereby stripping the top cartridge from the magazine and loading it into the chamber. This action also cocks the hammer of the pistol and leaves the hammer in a cocked position.

After chambering a cartridge, the hammer remains in a cocked position such that pulling the trigger will discharge the weapon. Various safety mechanisms are known for preventing inadvertent discharge of the firearm when the trigger is pulled while the hammer is in a cocked position. Such safety mechanisms generally either prevent the sear from releasing the hammer, lock the hammer in the cocked position, or prevent the trigger from being pulled. However, as with the manual firing pin lock, the use of such a safety mechanism is often undesirable when rapid and expected use is likely.

Thus, it is often desireable to have a cartridge chambered; but due to the double action operation of the pistol, it is not necessary to maintain the hammer in a cocked position. Indeed, it is frequently more desireable to maintain the hammer in a decocked position. This is because it takes a substantially greater amount of force to depress the trigger and discharge the firearm when the hammer is in the decocked position. As such, additional force must be provided by the user to cock the hammer, instead of merely releasing it to fall upon the firing pin (i.e. it requires a much more deliberate action to depress the trigger of a decocked double action firearm than to depress the trigger of a cocked double action firearm). This additional force is necessary to overcome the hammer spring tension as the hammer is raised to the cocked position. Such additional force makes an accidental discharge less likely. For example, if a foreign object inadvertently engages the trigger, it is much less likely that an accidental discharge will occur if the hammer is decocked.

Therefore, a common problem associated with double action semi-automatic pistols is the safe lowering of the hammer after manually chambering a cartridge. It may be desired to lower the hammer, thus decocking the firearm, when the gun is to be carried in a holster, stored for an extended period of time, or when it is otherwise desireable not to have the hammer in a cocked position. Many police departments require that their officers carry their firearm with a cartridge in the chamber and the hammer in a decocked position.

A common method for decocking a firearm is to grasp the hammer with the fingers of one hand while holding the firearm in the other hand and pulling the trigger. Grasping the hammer prevents it from falling forcefully upon the firing pin and thus discharging the gun. However, occurrences of inadvertent discharges while attempting this procedure are not uncommon. Since such inadvertent discharges can cause injury and death, it is very desireable to provide a means for lowering the hammer of such a firearm in a safe and convenient manner.

Various decocking or hammer drop mechanisms are known. One such mechanism slowly lowers the hammer to its decocked position such that the hammer does not strike the firing pin with enough force to drive the firing pin into the chambered cartridge. Another mechanism rotates a portion of the firing pin out of the path of the falling hammer such that the hammer cannot strike the end of the firing pin. In this instance the trigger may be pulled to cause the hammer to drop, since it is prevented from striking the displaced firing pin. Alternatively, the mechanism which displaces the portion of the firing pin may also cause the hammer to drop.

A means for lowering the hammer in a single action semi-automatic pistol would likewise be desireable since it is often desired to maintain a single action semi-automatic pistol with a chambered cartridge. This is true even though the hammer of a single action pistol must be separately cocked prior to firing the first cartridge.

Additionally, in the prior art, much weight has been given to the ability of the barrel bushing to firmly secure the front end of the barrel in position. The accuracy of the firearm depends upon the repeatability with which the barrel can be repositioned relative to the sights.

Various bushings for repositioning the forward end of the barrel after each shot are well known. The simplest of such bushings merely receive the front end of the barrel, holding it in place until the firearm is discharged. During discharge, the bushing travels rearward along the barrel. When the barrel unlocks from the slide, the bushing permits slight rotation of the barrel relative to the slide. Such rotation is necessary to accommodate the unlocking/locking motion of the barrel. Such simple bushings must therefore incorporate a slightly oval, elongated, or oversized central aperture.

Through the use of close tolerances, an attempt is made to securely restrain the forward end of the barrel within the bushing prior to discharging the firearm. The requirement for such close tolerances causes the firearm's accuracy to degrade as the bushing wears and the tolerances are lost. Also, close tolerances require the mechanism be maintained comparatively free from contamination. Dirt, sand, lint, and other contaminants can cause the bushing to bind upon the barrel and jam the firearm. The use of close tolerances increases the rate at which the barrel bushing wears due to friction. Fabrication of barrel bushings having close tolerances is comparatively difficult and expensive.

Thus, the prior art has concentrated efforts for achieving superior accuracy upon the ability of the barrel bushing to firmly secure the forward end of the barrel in position. Other mechanisms, such as Colt's collet type barrel bushing, disclosed in U.S. Pat. No. 3,564,967 issued to La Violette have been used to achieve this result. All such methods of firmly securing the forward end of the barrel in position are characterized by the requirement for closely held tolerances which tend to degrade over time and thus cause the firearm's accuracy to deteriorate.

Another common problem with prior art bushings is cracking due to the repeated application of stress when the gun is fired. This is particularly true of the Colt collet type bushing wherein comparatively delicate fingers secure the barrel in place. Such fingers are subject to the development of stress cracks. Consequently, they occasionally break off whereupon they may cause the gun to jam.

It would be desirable to repeatably position the barrel without requiring that the forward end of the barrel be firmly secured in place. It would also be desireable to eliminate the need for close tolerance in the fabrication of barrel bushings. Additionally, it would be desireable to provide a barrel bushing which is not susceptible to malfunction due to stress.

In addition, colored inlays formed upon the front and rear sights of firearms for aiding the user in the aiming process are well known. Typically a single round or rectangular inlay is provided upon the firearms front sight and two round inlays are provided on either side of the central groove of the rear site. Such inlays are typically colored either white or red to provide a stark contrast to the deep blue or black color of the gun sights. The use of colored inlays provides highly visible reference points by which the user can quickly align the sights upon a target.

Such inlays are used by aligning the inlay formed upon the front sight between the two inlays formed upon the rear sights. This process is hastened by the ease with which the colored inlays are perceived by the user. The red or white inlays can be quickly spotted and rapidly brought into rough alignment.

However, precise alignment of the prior art inlays is relatively difficult. The curved peripheries of the round inlays used upon the rear and/or front sights do not provide an easy means for judging alignment. In the prior art, the user must either align round rear inlays to a round front inlay or round rear inlays to a rectangular front inlay.

As will be recognized, it is difficult to align curved lines to each other or to a straight line. The curved lines do not provide a single reference for alignment, but rather present the user with the task of defining a reference. The user must align the round inlay by concentrating upon some portion thereof. For example, the user may attempt to visually determine the center point of the round inlay on the front sight and align it to similarly determined center points on round inlays of the rear sights.

Thus, although prior art firearms have proven generally suitable for their intended purposes, they possess inherent deficiencies which detract from their safe use and reduce accuracy below that theoretically obtainable. This detracts from their overall effectiveness in the marketplace.

In view of the shortcomings of the prior art, it is desirable to provide an improved firearm having a trigger actuated passive firing pin lock, a convenient and safe means for lowering the hammer of a firearm having a chambered cartridge, a barrel bushing which accurately repositions the forward end of the barrel relative to the sights, and sight inlays which allow the user to quickly and precisely aim the firearm.

SUMMARY OF THE INVENTION

The present invention specifically addresses and alleviates the above mentioned deficiencies associated in the prior art. More particularly, the present invention comprises an improved firearm having one or more safety and performance features such as a passive firing pin lock, a hammer drop mechanism, a V-block type barrel bushing, and square sight inlays.

The passive firing pin lock of the present invention prevents an accidental discharge when the gun is dropped. The passive firing pin lock is comprised of a lever which engages the firing pin and locks the firing pin in position such that the firing pin cannot travel forward and discharge a chambered cartridge. The lever pivots about a pin between an engaged or safe position and a disengaged or fire position. The lever is biased in the safe position by a spring.

Pulling the trigger rotates the sear to disengage a catch formed upon the sear from a notch formed upon the hammer and thus permits the hammer to fall. Prior to rotating sufficiently to cause the hammer to fall, a pawl formed upon the sear engages a tab formed upon the passive firing pin lock lever, thus causing the lever to disengage the firing pin. This places the lever in the fire position wherein further rotation of the sear will cause the hammer to drop upon the firing pin and drive the firing pin forward, thus discharging the firearm.

Upon ignition of the propellant contained within the cartridge, the firing pin is immediately urged rearward by both the firing pin spring and a dynamic impulse imparted as gas pressure tends to re-flatten the primer. Upon retraction to its original position, the firing pin is immediately locked into place by the passive firing pin lock lever. This occurs prior to the user releasing the trigger. Thus, the firing pin is immediately locked into a safe position and the gun is thereby protected from accidental discharge.

By immediately locking the firing pin in a safe position, prior even to releasing the trigger, the probability of an accidental discharge is substantially reduced. For instance, if the gun should be forcibly struck, i.e. by a bullet or shrapnel, immediately after a shot has been fired, but prior to releasing the trigger, the firing pin will have been locked in a safe position and the gun will be prevented from discharging. Also, in the event that the user falls after firing a shot but prior to releasing the trigger, and the gun strikes a hard surface with sufficient force to drive the firing pin forward, the gun is again prevented from discharging.

The manufacture of a pistol having the passive firing pin lock of the present invention essentially involves the fabrication of a lever and a modification of the sear. By contrast, manufacture of the Khoury device involves the fabrication of two separate lever mechanisms and a pin lock. Thus, manufacture of the firing pin lock of the present invention involves fewer materials, less machining, and simplified assembly. This provides a substantial savings in manufacturing costs.

Additionally, locking of the firing pin in the safe position without the necessity of the trigger being released precludes the possibility that the pistol could operate in the fully automatic mode in the event of a sear or disconnector malfunction. Operation of the firearm in the fully automatic mode is extremely dangerous since it typically occurs unexpectedly and results in the rapid discharge of several cartridges. In the event of such an occurrence the user often does not maintain full control of the firearm since the discharge of more than one cartridge is not expected. Therefore, several shots could be fired in an unsafe direction, resulting in death or injury. The ability to lock the firing pin in place immediately without the necessity of releasing the trigger therefore reduces the likelihood of such an occurrence.

The passive firing pin lock of the present invention is also particularly well suited for use in a double action only firearm. While most double action firearms can be operated in either a double action or single action mode, double action only firearms can only be fired in a double action mode. Double action only firearms do not have a hammer notch and sear catch for holding the hammer in a cocked position and must therefore be fired from the decocked position, i.e. in a double action mode.

In a double action only firearm it is often desired that the weapon be as simple to operate as possible. Thus, external manually operated safeties are not desirable. It is usually intended that such firearms be capable of being used by merely aiming and pulling the trigger.

Since the hammer of a double action only firearm does not remain in a cocked position after firing, it follows the slide forward as the next round is chambered. The hammer thus pushes the firing pin slightly forward as the slide moves into battery. Therefore, the firing pin may actually contact the primer of a chambered cartridge as the slide is brought into battery. While the firing pin does not strike the primer with sufficient force to cause the firearm to discharge, it is nevertheless undesirable to permit the firing pin to contact the primer except when a discharge is intended.

The passive firing pin lock of the present inventory prevents the firing pin from contacting the primer of a chambered round as the slide is brought into battery. This adds an extra margin of safety to the firearm. The firing pin cannot contact the primer since the firing pin is locked into a retracted position as the slide travels rearward and remains locked as the slide moves forward into battery.

The passive firing pin lock of the present invention thus provides a means whereby a double action only firearm may be constructed without the need for an externally operated manual safety and without permitting the firing pin to contact the primer of a chambered round as the slide moves into battery after the round is chambered.

In addition, the present invention incorporates a novel hammer drop mechanism which permits the hammer to be safely lowered when a cartridge is present in the chamber. This is accomplished without touching the trigger of the firearm. The hammer drop mechanism is comprised of first and second hammer drop shafts which are inserted into the slide at diametrically opposed positions and connect to form a single shaft having three cam surfaces formed thereupon. An external thumb lever formed upon one of the shafts permits the shaft to be manually rotated by the user. Rotation of the shaft engages two of the cams against the firing pin, thus withdrawing the firing pin beyond the firing pin retainer and into the slide such that the hammer can no longer strike the firing pin. Further rotation of the shafts cams a hammer drop push rod downward against the sear, thus causing the sear to rotate and release the hammer.

The use of two cams to withdraw the firing pin provides redundancy such that the firing pin will be safely retracted in the event of excessive wear or malfunction of one of the cams. Thus, even if one cam fails, the firing pin will still be retracted within the slide prior to the hammer falling.

Therefore, in operation the hammer drop mechanism of the present invention first repositions the firing pin within the slide to prevent contact with the hammer and then actuates the hammer causing it to fall to a decocked position. The hammer drop mechanism of the present invention thereby provides a safe and convenient means for a user to lower a semi-automatic pistol's hammer when a cartridge is chambered.

A V-block type barrel bushing of the present invention accurately repositions the forward end of the barrel relative to the sights to provide maximum accuracy. The V-block type barrel bushing of the present invention is comprised of two flat contact surfaces formed as an integral part of the slide and configured to contact the front end of the barrel tangentially at two locations. The use of such a V-block provides an extremely accurate means for repeatably positioning a cylindrical object. Thus, in the same manner that a machinist might axially position a section of bar stock prior to drilling, the forward portion of the barrel is precisely positioned prior to discharging the pistol.

Since the V-block bushing of the present invention does not attempt to firmly secure the front end of the barrel in place but rather repeatedly locates the front end of the barrel in a consistent position relative the slide, friction is minimized and bushing failure is eliminated. Also, the requirement for close tolerance machining is eliminated since the exact positioning and dimensions of the V-block are unimportant. It is merely necessary that the two contact surfaces be formed at approximately the five and seven o'clock positions and be tangential to the barrel. Use of the V-block barrel bushing of the present invention therefore provides the best accuracy theoretically possible while eliminating the prior art problems of wear and malfunction.

Further, the present invention discloses the use of square sight inlays or indicia. The square sight markings of the present invention are preferably comprised of a single square inlay formed upon the front sight and one square inlay formed upon either side of the groove in the rear sight. The square inlays are positioned such that when all three of their upper and lower edges are aligned and the square inlay formed upon the front sight is centered between the square inlays formed upon the rear sights, then the gun is on target. The advantages of such square inlays lie in the ability to rapidly align their upper and lower edges and the ability to perceive very small discrepancies in alignment.

It is a simple matter for the user to vary the elevation of the gun to achieve alignment of the upper and lower edges of the square inlays. The user simply concentrates upon either the upper or lower edges of the square inlays and tilts the gun to bring them into alignment. When aligned, both the upper and lower edges of the square inlays form a pair of single lines such that any deviations in the alignment of the inlays is immediately apparent and can be corrected.

Alignment of sights having round inlays is far more difficult by comparison. There are no straight lines for the user to bring into alignment. Therefore the user must rely upon his ability to perceive corresponding points within each round inlay and attempt to align these imagined corresponding points. For example, the user may concentrate upon aligning the centers of the round inlays. This is extremely difficult since the centers are only defined within the user's mind and are therefore extremely difficult to align with any precision. The user may also attempt to align the sights by concentrating upon the uppermost portion of the outer perimeter of each round inlay. This is likewise extremely difficult since the precise location of the uppermost point of the perimeter of each round inlay again exists only within the user's mind. The user must therefore attempt to determine the precise location of either the center, uppermost portion of the perimeter, or some other distinctive portion of each round inlay and do this subconsciously while also aligning the sights upon the target.

Aligning the square inlay sights of the present invention in azimuth is also greatly simplified over contemporary round inlays. In the present invention it is simply necessary to insure that the front sight square inlay is centered between the two rear sight square inlays by rapidly providing an equal distance between each of the two rear sight square inlays and the front square inlay. This is a simple matter since the user is aligning straight vertical lines. That is, it is a simple matter to visually determine the distance between vertical straight lines. By contrast, it is far more difficult to determine the distance between adjacent circular edges. In order to determine the distance between adjacent circular edges, it is first necessary to imagine points upon each of the circular edges from which the determination is to be made. Thus, the user must again use judgement to form an imaginary point upon the circumference of each of the round inlays and to form a mental measurement therebetween.

As such, the square sight inlays of the present invention provide a means of rapidly and accurately aligning the sights upon a target without having to rely upon the user's ability to mentally measure distances between curved objects. The square sight inlays thus allow the user to quickly and precisely aim the firearm.

These, as well as other advantages of the present invention will be more apparent from the following description and the drawings.

BRIEF DESCRIPTION OF THE DRAWINGS

FIG. 7 is a cross-sectional side view of the rear portion of the slide and receiver of the pistol of FIG. 1;

FIG. 7A is an enlarged cross-sectional side view of the rear portion of the slide and receiver shown in FIG. 7 depicting the hammer in its cocked position, the sear engaging the hammer, and the passive firing pin lock lever positioned to block the forward motion of the firing pin;

FIG. 8 is a cross-sectional side view of the rear portion of the slide and receiver of the pistol of FIG. 1 depicting the hammer in the cocked position, the sear disengaged from the hammer, and the passive firing pin lock lever disengaged from the firing pin;

FIG. 9 is a cross-sectional side view of the rear portion of the slide and receiver of the pistol of FIG. 1 depicting the hammer in the decocked position, the sear disengaged from the hammer, the passive firing pin lock lever disengaged from the firing pin, and the firing pin in its forward most position;

FIG. 10 is a cross-sectional side view of the rear portion of the slide and receiver of the pistol of FIG. 1 depicting the slide in its rear most position, the hammer in its cocked position, the passive firing pin lock lever engaging the firing pin, and the sear engaging the hammer;

FIG. 14 is a cross-sectional side view of the rear portion of the slide and receiver of the pistol of FIG. 1 showing the hammer drop mechanism of the present invention with the thumb lever in the horizontal or unactuated position;

FIG. 14A is an enlarged cross-sectional view of the hammer drop push rod cam engaging the hammer drop push rod as shown in FIG. 14;

FIG. 14B is an enlarged cross-sectional view of the first firing pin cam about to engage the first firing pin camming surface of the firing pin as shown in FIG. 14;

FIG. 14C is an enlarged side view of the second firing pin cam about to engage the second firing pin camming surface as shown in FIG. 14, the second firing pin camming surface being shown in dashed lines;

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
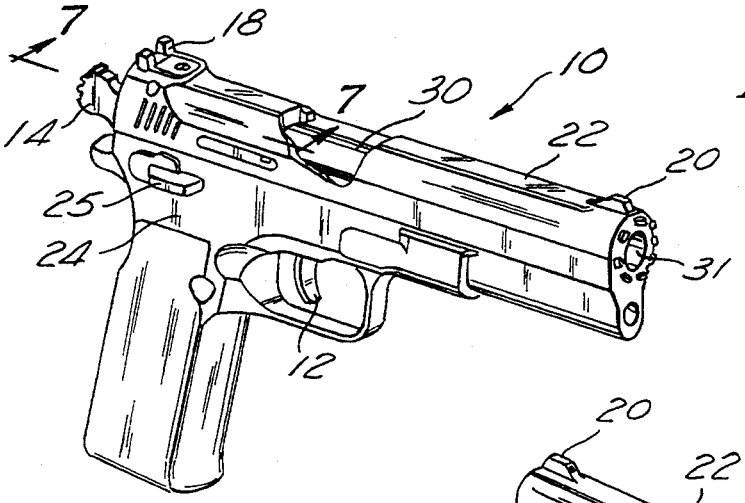
FIG. 1 is a perspective view of the right side of a semi-automatic pistol in accordance with the preferred embodiment of the present invention.
Figure 2:
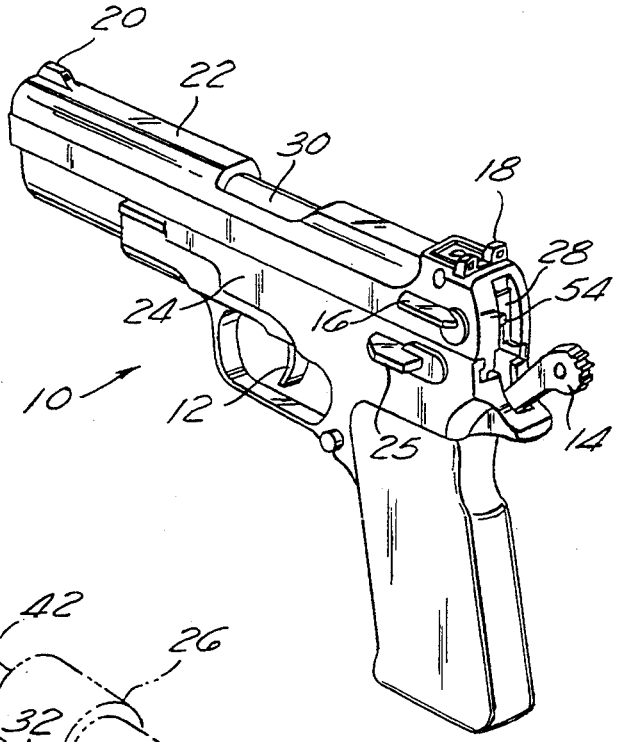
FIG. 2 is a perspective view of the left side of the semi-automatic pistol of FIG. 1.
Figure 3:
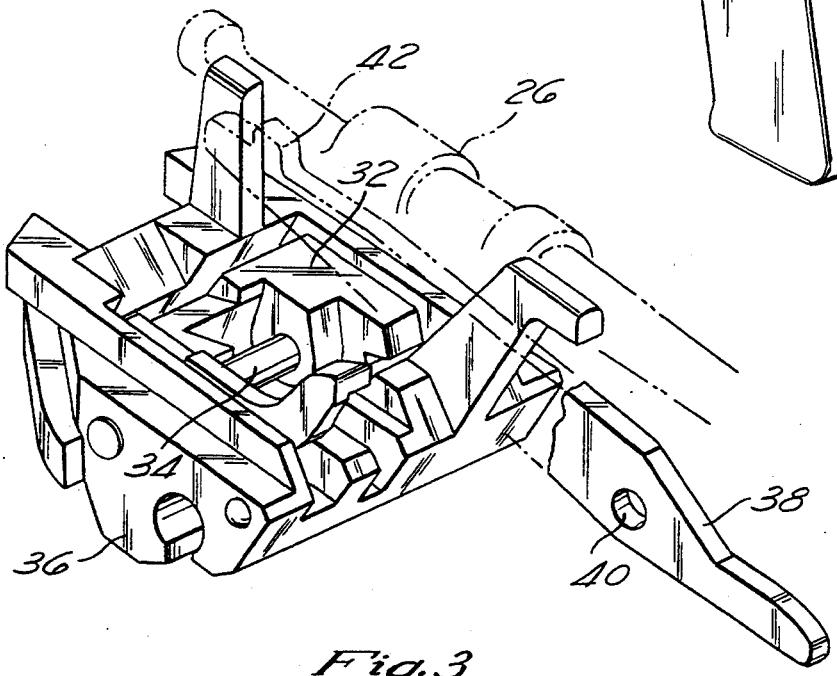
FIG. 3 is a perspective view of the passive firing pin lock of the present invention showing the sear, sear housing, passive firing pin lock lever, and the firing pin, the firing pin being shown in the phantom, and the passive firing pin lock lever being shown partially in phantom.
Figure 4:
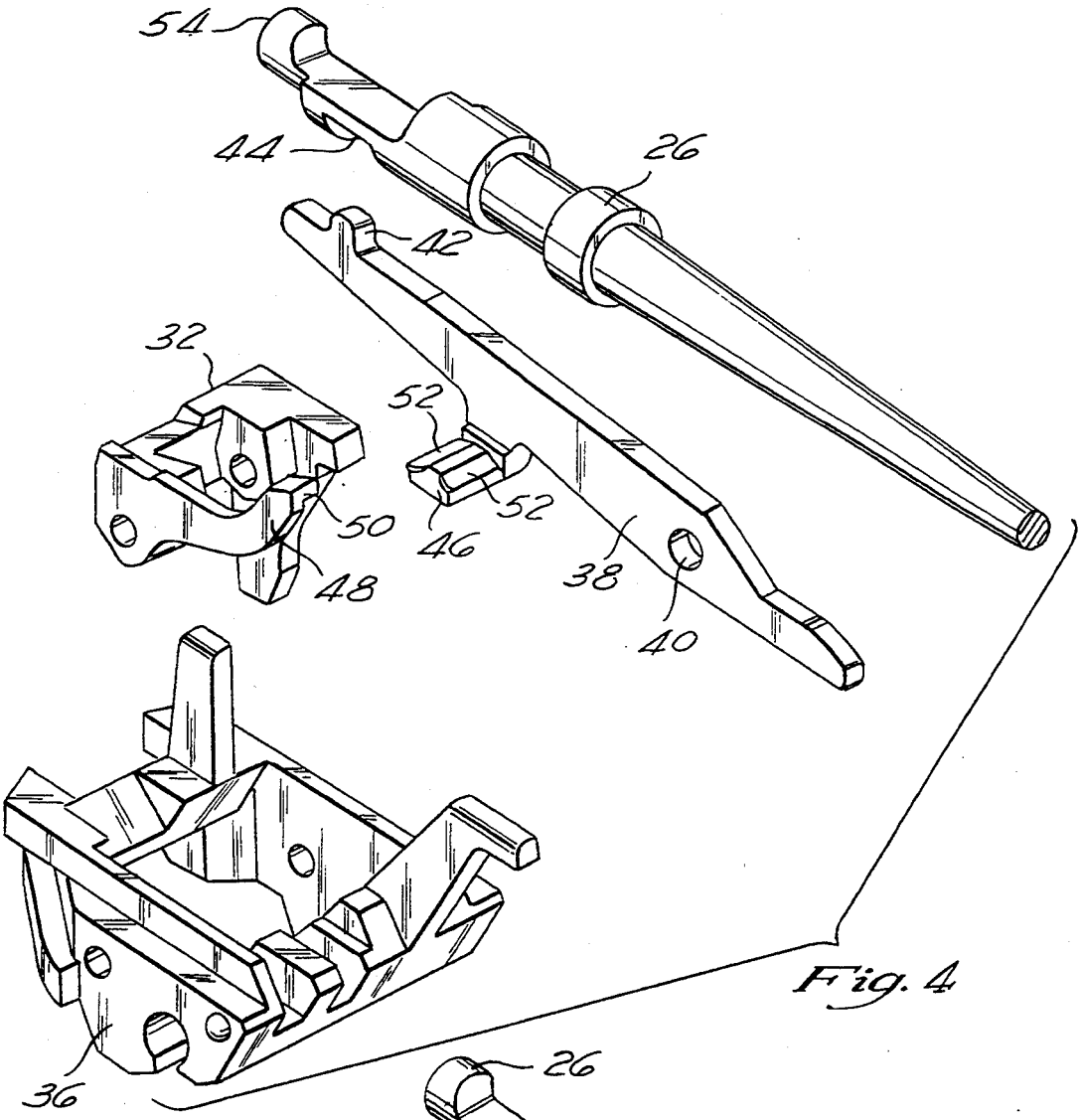
FIG. 4 is an exploded view of the sear housing, sear, passive firing pin lock lever, and firing pin of FIG. 3.
Figure 5:
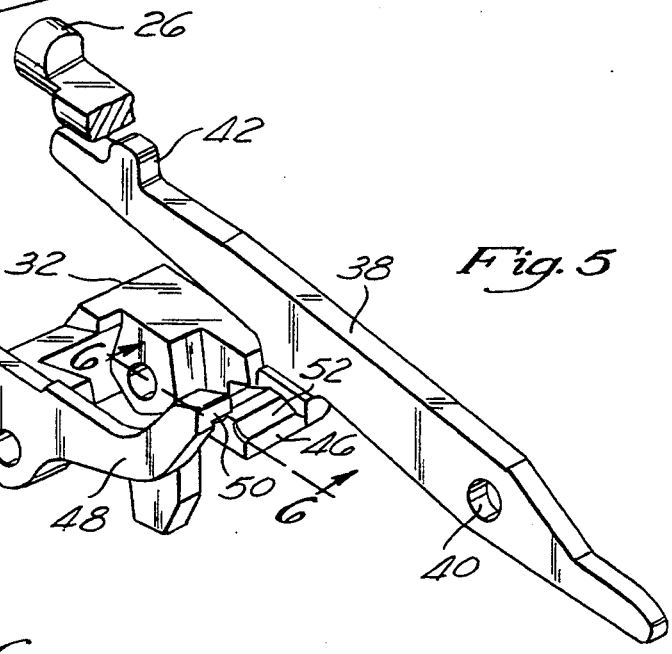
FIG. 5 is a perspective view of the sear, passive firing pin lock lever, and a portion of the firing pin of FIG. 4.

The firearm of the present invention is illustrated in FIGS. 1–23 which depict a presently preferred embodiment of the invention. Referring now to FIGS. 1 and 2, a pistol 10 in accordance with the present invention is comprised generally of a receiver 24 and a slide 22 disposed for reciprocal motion upon the receiver 24. A trigger 12 protrudes from the lower portion of receiver 24 to actuate, through conventional internal mechanisms, a hammer 14. A manually operated safety 25 prevents the trigger 12 from discharging the pistol 10 as in the prior art. As is well known, when trigger 12 is actuated, the hammer 14 strikes firing pin striking surface 54 and firing pin retainer 28. Rear 18 and front 20 sights provide for the alignment of barrel 30 with a target. In the preferred embodiment, the pistol 10 comprises a semi-automatic handgun, such as that depicted in U.S. Pat. No. 4,726,136 issued to Dornaus et al. the disclosure of which is expressly incorporated herein by reference. In this regard, the present invention comprises a specific improvement over the hand gun disclosed in U.S. Pat. No. 4,726,136 but is additionally applicable to other types of firearms.

Referring now to FIGS. 3 through 6, the passive firing pin lock of the preferred embodiment of the present invention is depicted. A sear 32 is pivotally disposed within sear housing 36. Sear housing 36 is disposed within the receiver of FIGS. 1 and 2 proximate the hammer 14. The sear 32 pivots about sear pin 34. An arm 48 extends from the sear 32 and has a pawl 50 formed upon the distal end thereof.

Passive firing pin lock lever 38 is pivotally mounted within the slide 22 above the sear 32. Lever 38 pivots about lever pin 41 (shown in FIG. 7 and 7A) which extends through aperture 40 formed in lever 38. Lever 38 has a detent 42 formed upon one end thereof. A tab 46 extends perpendicularly from approximately the middle of the lever 38. A contact surface 52 is formed upon the upper surfaces of the tab 46.

An inertial firing pin 26 is disposed within the slide 22 immediately above the passive firing pin lock lever 38. The firing pin 26 has a recess 44 formed in the lower rear surface thereof and sized to receive the detent 42 formed upon the lever 38. Firing pin striking surface 54 of firing pin 26 extends through the firing pin retainer 28 as shown in FIG. 2.

In the present invention, as well as in the prior art, depression of the trigger 12 is mechanically communicated to the sear 32 via linkage (not shown), thus causing the sear to rotate to permit the hammer 14 to fall upon the firing pin retainer 28 and striking surface 54 of the firing pin 26. The firing pin 26 is thus driven forward toward the primer of a chambered cartridge, against the biasing force of a firing pin spring 62 (as shown in FIGS. 7–10). The inertia of the firing pin 26 causes it to strike the primer with sufficient force to detonate the primer, thus discharging the firearm.

Clockwise (as viewed in FIG. 3) rotation of the lever 38 engages a detent 42 within a recess 44 formed in the lower rear portion of the firing pin 26. Engagement of the detent 42 within the recess 44 of firing pin 26 thus prevents forward translation of the firing pin 26 within the slide 22. Clockwise rotation of the sear 32 causes the tab 46 formed upon lever 38 to be engaged by pawl 50 of sear 32.

Figure 6:
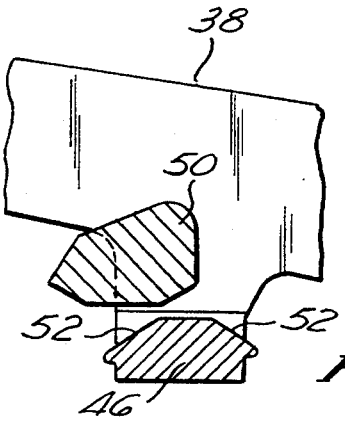
FIG. 6 is a sectional view of the sear and a portion of the passive firing pin lock lever taken along line 6—6 of FIG. 5.

As can be seen in the cross sectional view of FIG. 6, the pawl 50 formed upon the distal end of arm 48 engages contact surface 52 of tab 46 when pawl 50 moves downward in response to clockwise rotation of the sear 32. Thus, clockwise rotation of the sear 32 causes lever 38 to rotate counterclockwise, and to disengage detent 42 from recess 44 of firing pin 26. Detent 42 of the passive firing pin lock lever 38 engages the recess 44 formed within firing pin 26 at all times except when the trigger 12 is depressed to fire the pistol 10.

As in the prior art, clockwise rotation of the sear 32 disengages the hammer 14 from the sear 32 thus permitting the hammer 14 to fall and strike the firing pin 26. The firing pin 26 travels forward to discharge a chambered round in response to the striking surface 54 of the firing pin 26 being struck by the hammer 14. The detent 42 of the present invention is disengaged from the recess 44 of the firing pin 26 immediately prior to the disengagement of the hammer 14 from the sear 32.

The detent 42 is engaged within the recess 44 of the firing pin 26 at all times other than when the trigger 12 is depressed, thus effectively preventing accidental discharge of the pistol 10. Dropping of the pistol 10 with its barrel downward, such that an accidental discharge would be likely in a prior art pistol, thus does not cause the firing pin 26 to travel forward under the force of its own inertia when the firearm strikes the floor.

Operation of the passive firing pin look of the present invention is presented in further detail with reference to FIGS. 7–10 wherein the lock is depicted in its various stages of operation as the trigger 12 is pulled and the pistol 10 is discharged.

With particular reference to FIGS. 7 and 7A, the pistol 10 is depicted with the hammer 14 in a cocked position and a cartridge 66 loaded in the chamber 30. The striking surface 54 of the firing pin 26 extends beyond the firing pin retainer 28 such that the hammer 14 will contact the striking surface 54 of the firing pin 26 and drive the firing pin 26 forward toward the cartridge 66 when the hammer 14 is released. Since the trigger has not yet been depressed, detent 42 on lever 38 is received by recess 44 of firing pin 26. Thus, the firing pin 26 is locked in a safe position and thereby prevented from translating forward and striking the cartridge 66. Spring 68 disposed against surface 70 of lever 38 biases lever 38 into this safe position.

If the pistol were to be dropped while in this safe configuration, the firing pin 26 would be prevented from moving forward under its own inertia and striking cartridge 66 with the tip 64 thereof. Thus, the probability of death or injury due to accidental discharge is reduced.

The sear catch 74 of sear 32 engages the hammer notch 72 of the hammer 14, thus maintaining the hammer 14 in its cocked position until the trigger 12 is pulled. Pulling the trigger 12 at this point will rotate (through a conventional mechanical linkage which is not shown) the sear 32 clockwise, thus disengaging sear catch 74 from hammer notch 72 and permitting the hammer to rotate clockwise under the biasing of the hammer spring (not shown), whereupon the hammer 14 will strike the striking surface 54 of the firing pin 26 and the firing pin retainer 28. Pawl 50 formed upon the end of arm 48 of the sear 32 does not contact tab 46 of lever 38 when the trigger 12 is not depressed.

With particular reference to FIG. 8, the passive firing pin lock is depicted after the trigger 12 has been depressed. Depressing the trigger 12 has caused the sear 32 to rotate clockwise sufficiently to permit sear catch 74 to disengage from hammer notch 72 such that hammer 14 will begin to rotate clockwise under the urging of the hammer spring (not shown), whereupon the hammer 14 will strike striking surface 54 and firing pin retainer 28. Immediately prior to sear catch 74 disengaging hammer notch 72, pawl 50 contacts tab 46 of the lever 38 and urges tab 46 downwardly. This causes detent 42 to disengage from recess 44. Thus, as hammer 14 rotates clockwise to strike the striking surface 54 of firing pin 26, firing pin 26 is unlocked from its safe configuration and placed in a fire configuration wherein firing pin 26 is free to travel forward to cause the discharge of the pistol 10.

With particular reference to FIG. 9, hammer 14 has struck the striking surface 54 of the firing pin 26, thus driving the firing pin 26 forward against the urging of spring 62. The tip 64 of firing pin 26 thus strikes cartridge 66 to discharge the pistol 10. The pawl 50 of the sear 32 holds the lever 38 in the fire configuration as the firing pin 26 rebounds rearward under the urging of spring 62.

With particular reference to FIG. 10, the reaction to the lead bullet moving forward causes the slide 22 to rapidly recoil longitudinally rearward, thus cocking the hammer 14, extracting the expended cartridge, and permitting another cartridge to be chambered. As the slide 22 travels rearward, tab 46 of lever 38 disengages sear pawl 50, thus permitting detent 42 to be again received by recess 44 of the firing pin 26.

Therefore, firing pin 26 is once again locked into the safe configuration before slide 22 returns to its rest position. As in the prior art, sear 32 rotates counterclockwise such that sear catch 74 engages hammer notch 72 thus preventing the hammer 14 from rotating clockwise and again striking the striking surface 54 of the firing pin 26. Thus, as the slide returns to its forward most position, the safe configuration of the firing pin 26 is once again attained.

Figure 11:
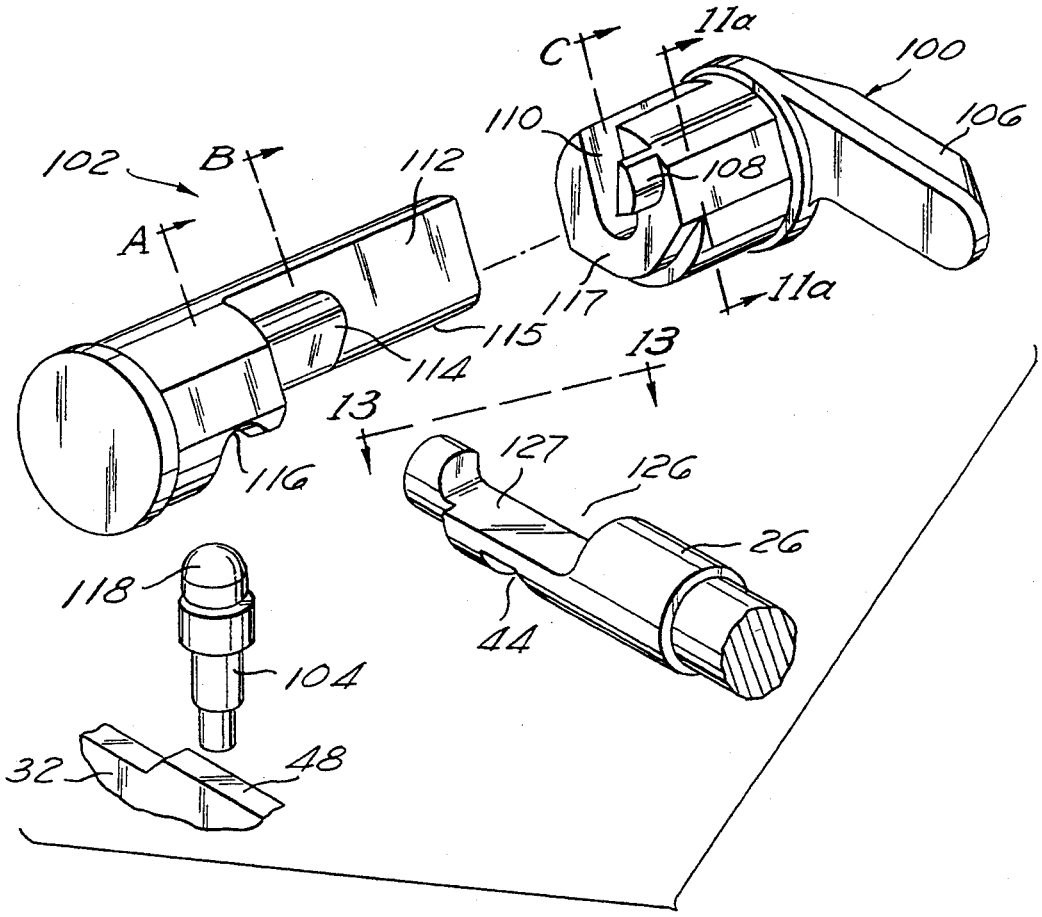
FIG. 11 is an exploded perspective view of the hammer drop mechanism of the present invention showing the first and second hammer drop shafts, the rear most portion of the firing pin, the hammer drop push rod, and a portion of the sear.
Figure 12:
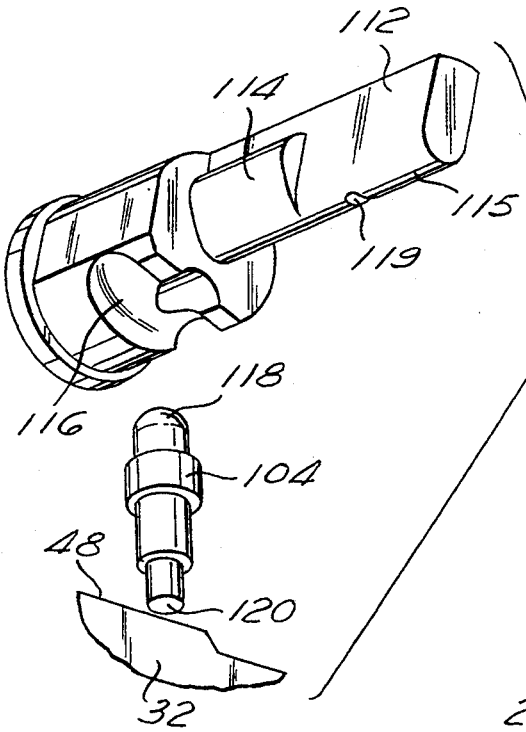
FIG. 12 is a perspective view of the second hammer drop shaft, the hammer drop push rod, and a portion of the sear of FIG. 11 showing the cam formed upon the second hammer drop shaft for camming the hammer drop push rod against the sear.
Figure 11A:
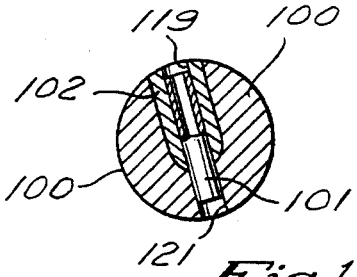
FIG. 11A is a cross-sectional view of the first and second hammer drop shafts taken along line 11A of FIG. 11 and a roll pin used to attach them together.
Figure 13:
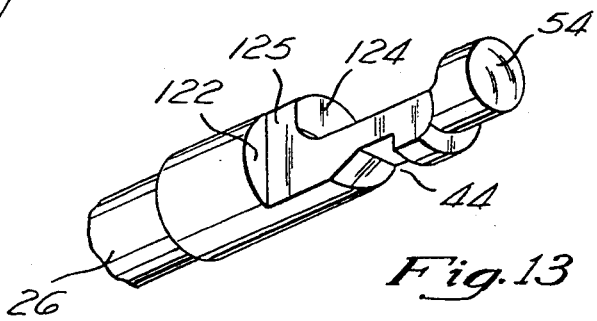
FIG. 13 is a sectional perspective view of a portion of the firing pin of FIG. 11 showing the two camming surfaces upon which the two cams formed upon the first and second hammer drop shafts act.

Referring now to FIGS. 11 through 13, the hammer drop mechanism of the present invention is depicted. The hammer drop mechanism is generally comprised of first 100 and second 102 shafts, the firing pin 26, hammer drop push rod 104, and sear 32. The first shaft 100 has a thumb actuation lever 106 formed upon one end thereof and a shaft recess 110 and second firing pin cam 108 formed upon the opposite end thereof. The second shaft 102 has a flat shaft portion 112, a first firing pin cam 114 and a hammer drop cam 116 formed thereupon.

First 100 and second 102 shafts are inserted into the slide 22 such that they may be attached together with pin 101 to form a single shaft which passes transversely through the slide 22 Pin 101 extends through aperture 119 in second shaft 102 and through aperture 121 in first shaft 100. Therefore, rotation of the first shaft 100 by depressing thumb lever 106 causes a like rotation of second shaft 102.

With particular reference to FIG. 12, the upper end 118 of hammer drop push rod 104 contacts the hammer drop cam 116 of second shaft 102 and the lower end 120 contacts the arm 48 of the sear 32. The flat shaft portion 112 is formed to be received by the shaft recess 110 of the first shaft 100. Thus, first shaft 100 and second shaft 102 attach together to form a single rotatable member.

With particular reference to FIG. 13, the firing pin 26 includes a first camming surface 124 and a second camming surface 122 formed thereon. The first camming surface 124 is adapted to engage the first firing pin cam 114 and the second surface 122 is adapted to engage the second firing pin cam 108.

The firing pin 26 is prevented from rotating about its longitudinal axis by the abutment of the lower surface 115 of the second shaft 102 against the upper flat surface 127 of recess 126 formed in the firing pin 26 and by the abutment of the edge 117 of the first shaft 100 against the flat side 125 of the firing pin 26.

Operation of the hammer drop mechanism of the present invention is presented in detail with reference to FIGS. 14–16C wherein the mechanism is depicted in various stages of operation as the thumb lever is depressed. Thumb lever 106 is biased in the up or unactuated position by the firing pin spring 62 acting through the firing pin 26 and by the hammer drop pin spring 105 acting through the hammer drop pin 104. Actuation of the thumb lever 106 cams the firing pin 26 into the slide 22 such that the striking surface 54 of the firing pin 26 is disposed beneath the hammer striking or outer surface 29 of the firing pin retainer 28 and consequently cannot be struck by the hammer 14. Further rotation of the thumb lever 106 actuates the sear 32, thus releasing the hammer 14 and permitting it to fall to a decocked position.

With particular reference to FIG. 14, the firing pin 26 is depicted in its rest position. The striking surface 54 of the firing pin 26 extends beyond the hammer striking or outer surface 29 of the firing pin retainer 28. The hammer drop cam 116 lightly contacts the upper end 118 of the hammer drop push rod 104. The first firing pin cam 114 is positioned almost in contact with the first camming surface 124 of the firing pin 26. The second firing pin cam 108 is positioned slightly above the second camming surface 122 of the firing pin 26. The hammer 14 is shown in the cocked position and maintained therein by the sear 32.

The hammer drop push rod 104 is disposed intermediate the second shaft 102 and the sear 32 such that rotation of the second shaft 102 in a clockwise direction by manipulation of the lever 106 will cause the hammer drop cam 116 to abut the uppermost end 118 of the hammer drop push rod 104 and translate the lower end 120 of the hammer drop push rod 104 downwardly against the bias of hammer drop push rod spring 105 into contact with the arm 48 of the sear 32. Continued rotation of the second shaft 102 in the clockwise direction rotates the arm 48 of the sear 32 downward, thus causing the sear catch 74 of the sear 32 to disengage the hammer notch 72 of the hammer 14. This permits the hammer 14 to rotate clockwise under the urging of the hammer spring (not shown). The three camming actions are discussed and illustrated in greater detail with respect to FIGS. 14A–14C.

With particular reference to FIG. 14A, when the thumb lever 106 is in the horizontal or rest position as in FIG. 14, the hammer drop cam 116 abuts the upper end 118 of the hammer drop push rod 104 without urging the hammer drop push rod 104 downward. That is, the upper end 118 of the hammer drop push rod 104 contacts the hammer drop cam 116 of the second hammer drop shaft 102 under the urging of hammer drop push rod spring 105 and there is no downward force upon the hammer drop push rod 104.

With particular reference to FIG. 14B, with the thumb lever 106 in the horizontal or rest position as in FIG. 14, the first firing pin cam 114 is positioned almost in contact with the first camming surface 124 of the firing pin 26 without urging the firing pin 26 forward.

With particular reference to FIG. 14C, with the thumb lever 106 in the horizontal or rest position as in FIG. 14, the second firing pin cam 108 does not contact the second camming surface 122 of the firing pin 26.

Figure 15:
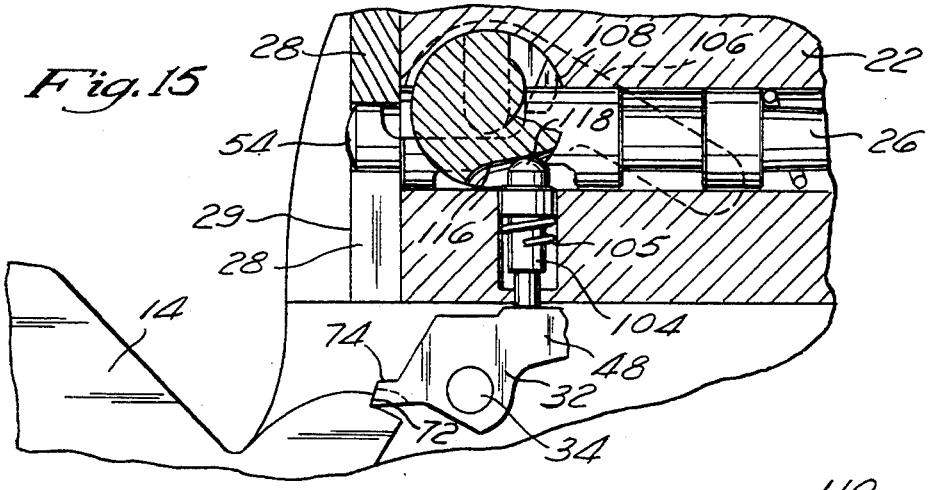
FIG. 15 is a cross-sectional side view of the rear portion of the slide and receiver of the pistol of FIG. 1 showing the hammer drop mechanism of the present invention with the thumb lever depressed to a position approximately midway in its travel.
Figure 15A:
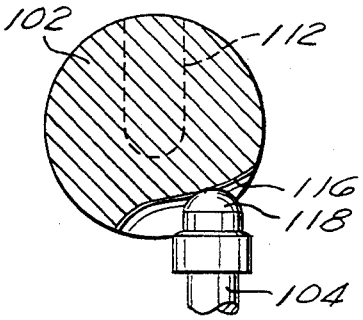
FIG. 15A is an enlarged cross-sectional side view of the hammer drop push rod cam engaging the hammer drop push rod as shown in FIG. 15.
Figure 15B:
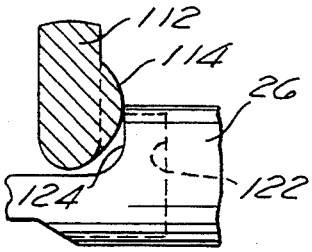
FIG. 15B is an enlarged cross-sectional side view of the first firing pin cam engaging the first firing pin camming surface of the firing pin as shown in FIG. 15.
Figure 15C:
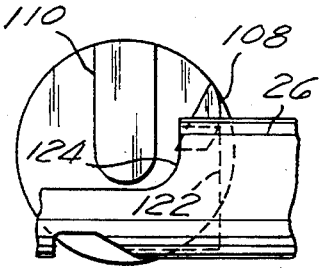
FIG. 15C is an enlarged side view of the second firing pin cam engaging the second firing pin camming surface of the firing pin as shown in FIG. 15.

Referring now to FIGS. 15–15C, the positions and interactions of the various components of the hammer drop mechanism of the present invention are shown when the thumb lever 106 has been rotated clockwise through approximately one half of its travel i.e. approximately 30 degrees from its initial at rest position of FIGS. 14A–14C. Rotating the thumb lever 106 to an intermediate position brings the hammer drop cam 116 firmly into contact with the upper end 118 of the hammer drop push rod 104. The hammer drop push rod 104 may translate downward slightly, but not sufficiently to cause rotation of the sear 32. Such rotation of the thumb lever 106 also causes first 114 and second 108 firing pin cams to begin camming the firing pin 26 forward such that the firing pin 26 is partially withdrawn into the slide 22.

In this position, the striking surface 54 of the firing pin 26 is approximately flush with the outer surface 29 of the firing pin retainer 28. Therefore, the firing pin 26 is withdrawn to a point where the dropping hammer 14 is incapable of driving the firing pin 26 forward to discharge the pistol 10. The firing pin 26 is withdrawn in this manner prior to initiating the process of disengaging the sear 32 from the hammer 14. That is, the hammer is prevented from falling upon the striker plate 28 until the firing pin 26 is well beneath the outer surface 29 of the firing pin retainer 28.

With particular reference to FIG. 15A, with the thumb lever 106 in an intermediate position as in FIG. 15, the hammer drop cam 116 is brought into firm contact with the upper end 118 of the hammer drop push rod 104 such that slight pressure begins to be applied to the arm 48 of the sear 32. The hammer drop cam 116 has not yet begun to urge hammer drop push rod 104 appreciably downward. Thus, the sear 32 does not yet begin to rotate clockwise and the sear catch 74 consequently firmly engages hammer notch 72 of the hammer 14.

With particular reference to FIG. 15B, with the thumb lever 106 in an intermediate position as in FIG. 15, first firing pin cam 114 has urged firing pin 26 forward sufficiently to bring the striking surface 54 of the firing pin 26 approximately flush with the outer surface 29 of the firing pin retainer 28.

With particular reference to FIG. 15C, with the thumb lever 106 in an intermediate position as in FIG. 15, second firing pin cam 108 provides a redundant means for urging firing pin 26 forward as thumb lever 106 is depressed. Second firing pin cam 108 abuts camming surface 122 formed upon firing pin 26 to simultaneously urge firing pin 26 forward in concert with cam 114 and camming surface 124. The redundant camming action assures that the striking surface 54 of the firing pin 26 is safely withdrawn into the slide 22 prior to dropping of the hammer 14. Thus, even in the event of wear or malfunction of one of the first 114 and second 108 firing pin cams and/or their corresponding camming surfaces 124 and 122, a safe means for lowering the hammer is maintained.

Figure 16:
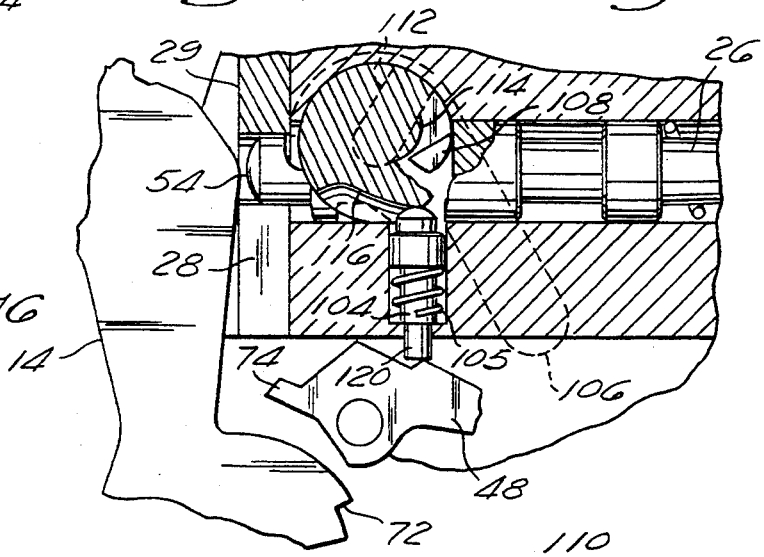
FIG. 16 is a cross-sectional side view of the rear portion of the slide and receiver of the pistol of FIG. 1 showing the hammer drop mechanism of the present invention with the thumb lever in its fully depressed position.
Figure 16A:
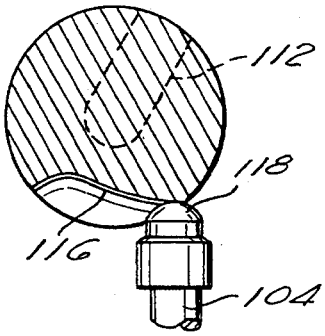
FIG. 16A is an enlarged cross-sectional side view of the hammer drop push rod cam depressing the hammer drop push rod as shown in FIG. 16.
Figure 16B:
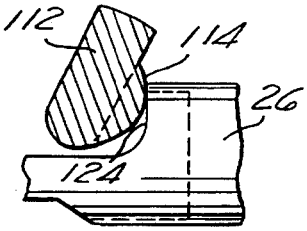
FIG. 16B is an enlarged cross-sectional side view of the first firing pin cam engaging the first firing pin camming surface of the firing pin as shown in FIG. 16.
Figure 16C:
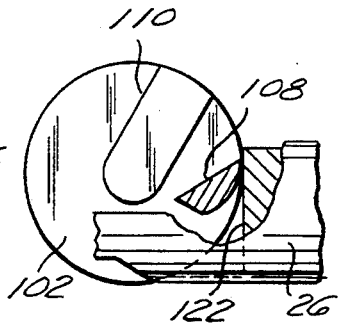
FIG. 16C is an enlarged cross-sectional side view of the second firing pin cam engaging the second firing pin camming surface of FIG. 16.

Referring now to FIGS. 16–16C, the position of the hammer drop mechanism as the thumb lever 106 is rotated through its full travel i.e. approximately 60 degrees from its initial at rest position of FIG. 14A–14C is depicted. As the thumb lever 106 nears the completion of its travel to the fully clockwise rotational position, the striking surface 54 of the firing pin 26 is withdrawn well below the outer surface 29 of the firing pin retainer 28 and the sear catch 74 disengages the hammer notch 72, thus allowing the hammer 14 to fall to a decocked position.

With particular reference to FIG. 16, the hammer has dropped from its cocked position and rests upon the firing pin retainer 28. With the thumb lever 106 in its fully rotated position the firing pin 26 is cammed forward such that the striking surface 54 thereof is disposed within the firing pin retainer 28 and cannot be contacted by the hammer 14 as the hammer 14 falls. The hammer 14 is prevented from striking the firing pin 26 and thereby discharging the pistol.

Thumb lever 106 and the rotatable member comprised of first 100 and second 102 shafts thus provide a single or common means for withdrawing the firing pin 26 and lowering the hammer 14. The three camming actions are discussed and illustrated in greater detail with respect to FIGS. 16A–16C.

With particular reference to FIG. 16A, it can be seen that the hammer drop cam 116 has urged the hammer drop push rod 104 against the urging of hammer drop push rod spring 105 fully to its lowermost position wherein the hammer drop push rod 104 has urged the sear 32 to rotate in a clockwise direction, thereby disengaging the sear catch 74 from the hammer notch 72.

With particular reference to FIG. 16B, with the lever 106 fully depressed as in FIG. 16 the first firing pin cam 114 has urged the firing pin 26 forward sufficiently to withdraw the striking surface 54 of the firing pin 26 beyond the hammer striking or outer surface 29 of the firing pin retainer 28.

With particular reference to FIG. 16C, with the thumb lever 106 fully depressed as in FIG. 16, in redundant fashion the second firing pin cam 108 has urged the firing pin 26 forward. The redundant operation of the first 114 and second 108 firing pin cams insures that the firing pin 28 is safely withdrawn beyond the hammer striking or outer surface 29 of the firing pin retainer 28 before the hammer 14 is released by the sear 32 to strike the firing pin retainer 28. Thus, the hammer 14 is safely decocked without discharging the pistol 10.

Figure 18:
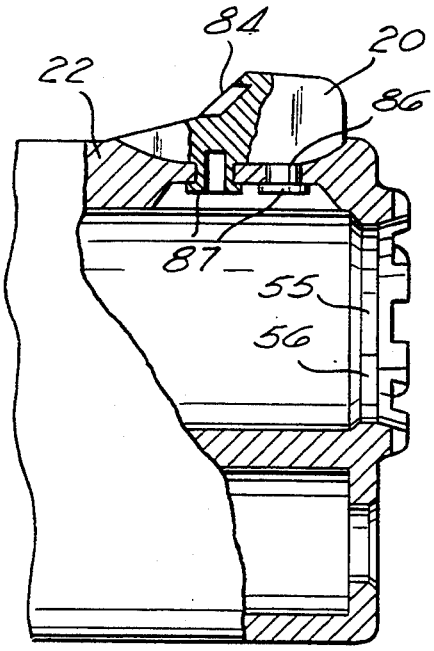
FIG. 18 is a cross-sectional side view of the V-block bushing of FIG. 17.
Figure 17:
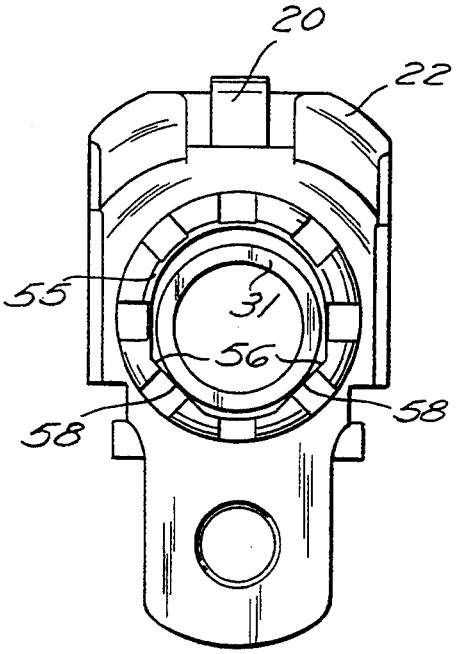
FIG. 17 is a front view of the V-block bushing of the present invention formed within the slide of the pistol of FIG. 1.

In addition to the improved safety features obtained by the present invention's use of the passive firing pin lock mechanism and hammer drop mechanism, the present invention provides improved performance characteristics by use of a V-block bushing and square front and rear sight system. Referring more particularly to FIGS. 17 and 18, the V-block bushing feature of the present invention is illustrated. As is conventional, the distal end of the slide 22 is provided with a bushing 55 which is threadingly inserted or press fit therewithin. The purpose of the bushing is to maintain the distal end of the barrel which is disposed within the interior of the slide 22 and position the distal end of the barrel at a repeatable location relative the slide 22 prior to discharge of pistol 10.

In contrast to prior art bushings, the bushing 55 of the present invention comprises a V-block bushing having a pair of tangential flats 56 formed adjacent its lower periphery adapted to tangentially contact the exterior diameter of the barrel 31. As best shown in FIG. 17, with the barrel 31 disposed in its fire position the exterior of the barrel 31 contacts the flats 56 formed on the V-block bushing 55 to axially center the barrel 31 relative the bushing 55 and thus the slide 22. Due to the barrel 31 being pivotally connected to the slide adjacent its opposite end and is thereby urged downwardly upon the flats 56 by lever action, the lower diameter of the barrel 31 contact the flats 56 at two tangential points, i.e. contact points 58 as indicated in FIG. 17.

As such, during movement of the slide 22 relative to the barrel 31, as during chambering of a cartridge within the barrel, upon the barrel 31 returning to its final position relative the slide 22, the barrel 31 is consistently and repeatably positioned at the same axial and vertical position relative the slide 22. Due to this repeatability, accuracy and discharge of the pistol 10 is effectuated merely by proper adjustment of the sight system of the pistol 10.

In FIGS. 19 through 23, the improved sight system of the present invention is depicted. As will be recognized, the sight system comprises a rear sight assembly 18 disposed within a recess 128 formed on the rear end of the slide 22 and a front sight 20 disposed on the opposite or front end of the slide 22 as best seen in FIGS. 1 and 2.

Figure 20:
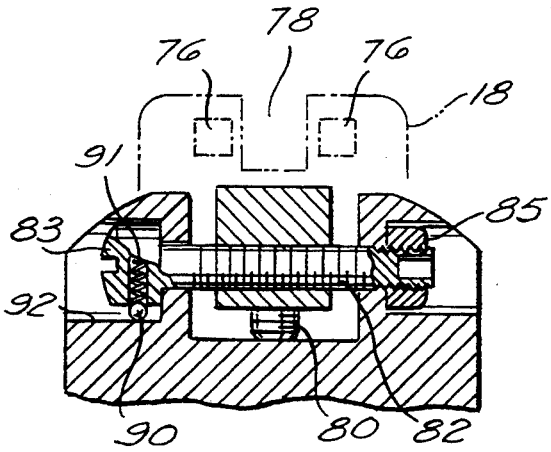
FIG. 20 is a cross-sectional view taken about lines 20—20 of the rear sight of FIG. 19 showing the two square inlays of the present invention.
Figure 19:
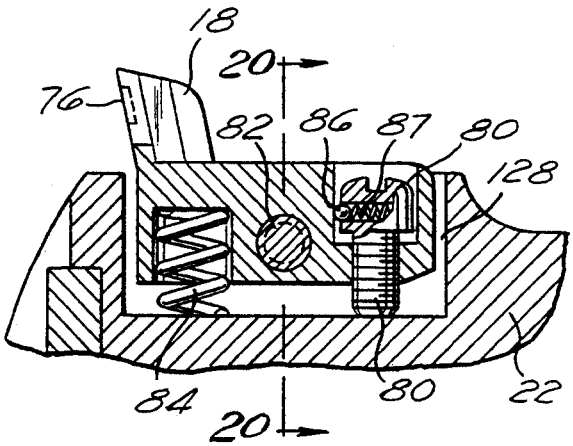
FIG. 19 is a cross-sectional side view of the rear sight of the pistol of FIG. 1.
Figure 21:
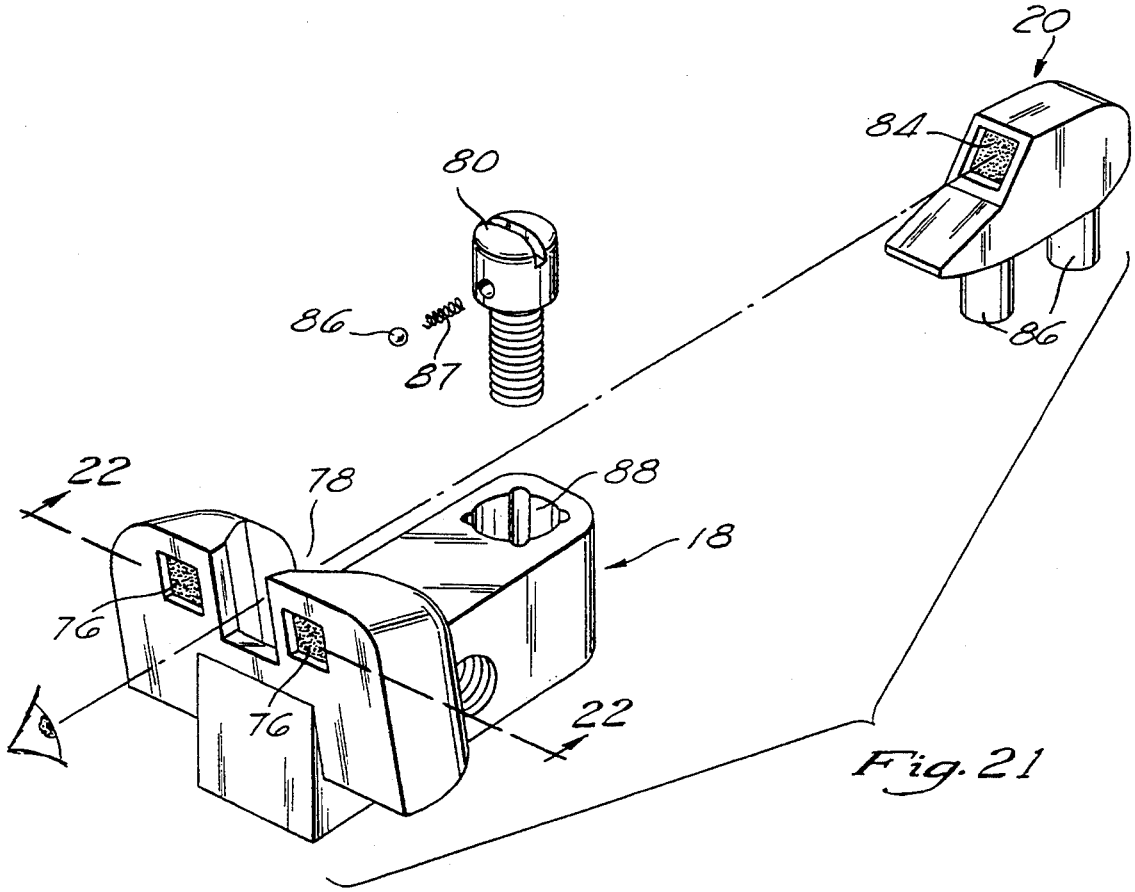
FIG. 21 is a perspective view of the front and rear sights showing the square inlays.

Referring now to FIGS. 19 through 21, the square inlay rear sight 18 of the present invention is depicted. One square inlay 76 is formed upon either side of the sight groove 78. The rear sight 18 is adjusted for elevation by turning elevation adjustment screw 80 to cause the rear sight 18 to pivot about windage adjustment screw 82 against the biasing of rear sight spring 84. Windage adjustment screw 82 secures rear sight 18 within recess 128 formed in slide 22.

Windage is adjusted by turning windage adjustment screw assembly 82 from the right side. Windage adjustment screw assembly 82 is comprised of screw 83 and slotted nut 85 such that a screwdriver can engage the windage adjustment screw assembly 82.

First ball detent 86 is urged outward by spring 87 to engage recesses 88 formed within the rear sight 18 and locks elevation screw 80 in position. A similar ball detent 90 is urged outward by spring 91 and is received by similar recesses 92 to lock windage screw 82 in position.

As shown in FIG. 21, the square inlay front sight 20 of the present invention has a single square inlay 84 formed upon its rear surface. The front sight 20 is secured to the slide 22 using two posts 86. The posts 86 are received within complimentary apertures formed within the slide 22 and the posts are peened to form flared ends 87 which secure the posts 86 therein as shown in FIG. 18.

Each square indicia inlay 76 or 84 is preferably formed by first forming a shallow square recess where the inlay is to be located. The recess is then filled with red or white epoxy, enamel, or other durable colored material. Those skilled in the art will recognize that other processes of forming the inlays are likewise suitable. Additionally, those skilled in the art will recognize that the square markings or indicia may simply be affixed upon the sights 18 and 20 as opposed to being inlayed or recessed therein.

Figure 22:
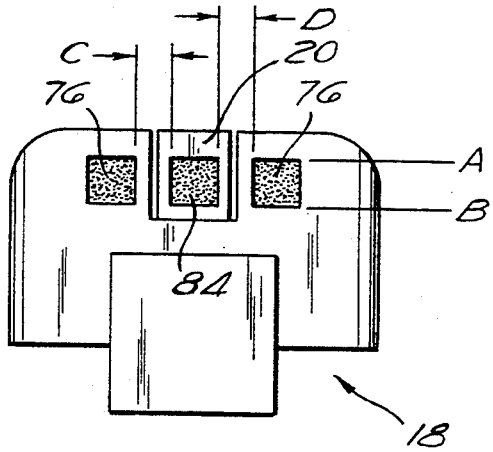
FIG. 22 is a rear view of the front and rear sights of FIG. 21.
Figure 23:
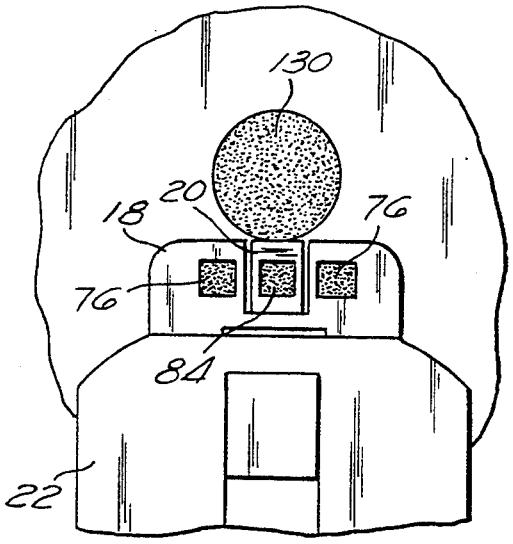
FIG. 23 is a rear view of the slide of the pistol of FIG. 1 showing alignment of the square inlays of the front and rear sights with a bull's-eye.

Referring now to FIG. 22 and 23, operation of the rear 18 and front 20 sights is depicted. In use, the upper and lower straight edges of the square inlays 76 and 84 are aligned to lie within a pair of straight lines A and B, thus aligning the pistol 10 in elevation. The vertical lines of the square inlays 76 and 84 are aligned such that equal distances C and D are achieved between the front sight inlay 84 and the two rear sight inlays 76. Alignment of the rear 18 and front 20 sights with a bull's-eye 130 is shown in FIG. 23. Such alignment can be rapidly and accurately obtained due to the ease with which straight lines can be visually aligned. It is a relatively simple matter to judge when the upper surfaces, for instance, of each square inlay 76 and 84 form a single straight line A. It is also relatively simple to judge the distances between adjacent inlays such that equal spacing of C and D is achieved.

Rear 76 and front 84 inlays are sized such that they appear approximately equal in linear dimensions to the user. That is, the front square inlay 84 is sized slightly larger than the two rear square inlays 76 so that when viewed in perspective by the user the more distant front square inlay 84 appears approximately equal in size to the closer rear inlays 76. This, of course, is most important when using the square inlays of the present invention upon a rifle wherein the distance between the front and rear sights is substantial.

While squares having four straight edges are depicted for each inlay 76 and 84, those skilled in the art will recognize that only the inboard vertical edges of rear sight inlays 76 and both vertical edges of front sight inlay 84 as well as either the top or bottom horizontal edges of all three inlays 76 and 84 need to be straight. This permits the definition of line A or B and distances C and D.

It is understood that the exemplary firearm described herein and shown in the drawings represents only a presently preferred embodiment of the invention. Indeed, various modifications and additions may be made to such embodiment without departing from the spirit and scope of the invention. For example, the lever of the passive firing pin lock could engage the firing pin in a variety of different ways. Also, various hammer drop mechanism configurations are possible for withdrawing the firing pin prior to actuating the sear and causing the hammer to fall. Additionally, the V-block barrel bushing may be formed as a separate removable element rather than as an integral portion of the slide as described. Additionally, the sight inlay of the present invention need not be square, but rather may use a variety of different shapes which provide straight horizontal and/or vertical surfaces which may be quickly and accurately aligned. Thus, these and other modifications and additions may be obvious to those skilled in the art and may be implemented to adapt the present invention for use in a variety of different applications.

What is claimed is:

1. A sight assembly for a firearm, said sight assembly comprising:

a) a rear sight having a groove formed therein;

b) a front sight disposed forward of said rear sight;

c) two colored first indicia formed upon said rear sight such that said rear sight defines a background therefor, one of said first indicia formed upon either side of the groove in said rear sight, each first indicia defining at least one straight horizontal edge against said background;

d) one colored second indicia formed upon said front sight such that said front sight defines a background therefor, said second indicia defining at least one straight horizontal edge against said background; and e) wherein the straight horizontal edges defined by said first indicia and the straight horizontal edge defined by said second indicia are configured to cooperate to form a single horizontal line when the firearm is aimed.

2. The sight assembly as recited in claim 1 wherein said first and second indicia comprise squares.

3. The sight assembly as recited in claim 1 wherein said first indicia and said second indicia are configured to appear approximately equal in size when the firearm is aimed.

4. The sight assembly as recited in claim 1 wherein said first indicia and said second indicia comprise inlays.

5. The sight assembly as recited in claim 1 further comprising:

a) a windage adjustment screw, said windage adjustment screw extending horizontally through a portion of the firearm and extending through said rear sight; and b) an elevation adjustment screw, said elevation adjustment screw extending vertically through said rear sight such that rotation of said elevation adjustment screw causes said rear sight to pivot about said windage adjustment screw.

* * * * *